United States Patent [19]

Hoxit

[11] Patent Number: 4,746,075

[45] Date of Patent: May 24, 1988

[54] PRECISION COIL WINDING MACHINE AND METHOD

[75] Inventor: Gary K. Hoxit, Easley, S.C.

[73] Assignee: General Electric Company, Schenectady, N.Y.

[21] Appl. No.: 902,015

[22] Filed: Aug. 29, 1986

Related U.S. Application Data

[63] Continuation of Ser. No. 678,857, Dec. 6, 1984, abandoned.

[51] Int. Cl.[4] ..... B65H 54/20; B65H 57/28

[52] U.S. Cl. ..... 242/7.16; 242/25 A; 242/158.2

[58] Field of Search ..... 242/7.02, 7.03, 7.16, 242/25 R, 25 A, 158 R, 158.2

[56] References Cited

U.S. PATENT DOCUMENTS

| | | | |
|---|---|---|---|
| 3,136,493 | 6/1964 | Swanson | 242/7.09 |
| 3,465,608 | 9/1969 | Bachi . | |
| 3,500,878 | 3/1970 | Moore . | |
| 3,811,630 | 5/1974 | Muskulus et al. | 242/7.14 |
| 3,951,355 | 4/1976 | Morioka et al. | 242/158 R |
| 4,022,391 | 5/1977 | Stein et al. | 242/158 R |

OTHER PUBLICATIONS

*Winding-Assembly & Automation,* Conference Paper of International Coil Winding Association, Peter Aumann, 1978, pp. 1-23.

*Primary Examiner*—John Petrakes
*Assistant Examiner*—Joseph J. Hail, III
*Attorney, Agent, or Firm*—John P. McMahon; Philip L. Schlamp; Fred Jacob

[57] ABSTRACT

A method and apparatus for precision winding of coils on bobbins. Ideal positions for all portions of wire on the bobbin are predetermined on the basis of a planned winding profile taking into account number of turns, wire size and bobbin dimensions. Then incremental control of traverse, simultaneously with spin of a fly head winder, relative to the bobbin is utilized to put the wire down on the bobbin at the ideal positions independently of the lay of prelaid turns. The control is preferably done through a computer whose memory contains essential data on the winding profile. The computer is programmed to read feedback signals on instantaneous traverse and spin and provide control signals to cause the winder to duplicate the coil winding profile.

5 Claims, 7 Drawing Sheets

Fig. 1
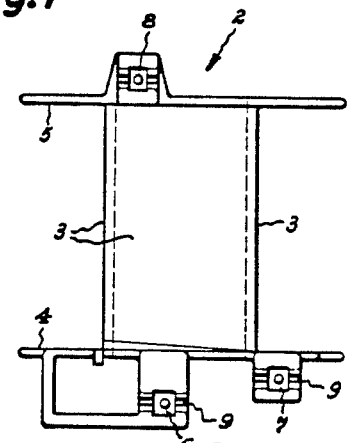
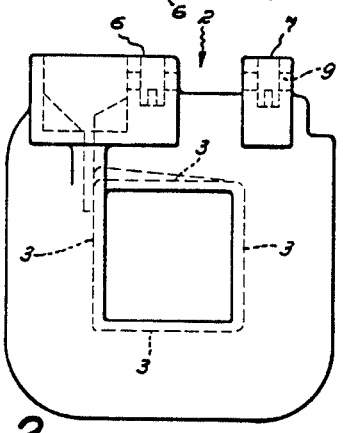
Fig. 2
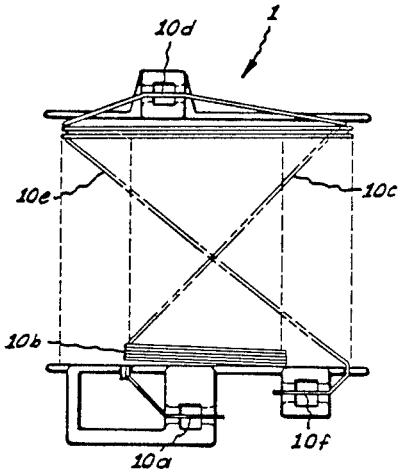
Fig. 3
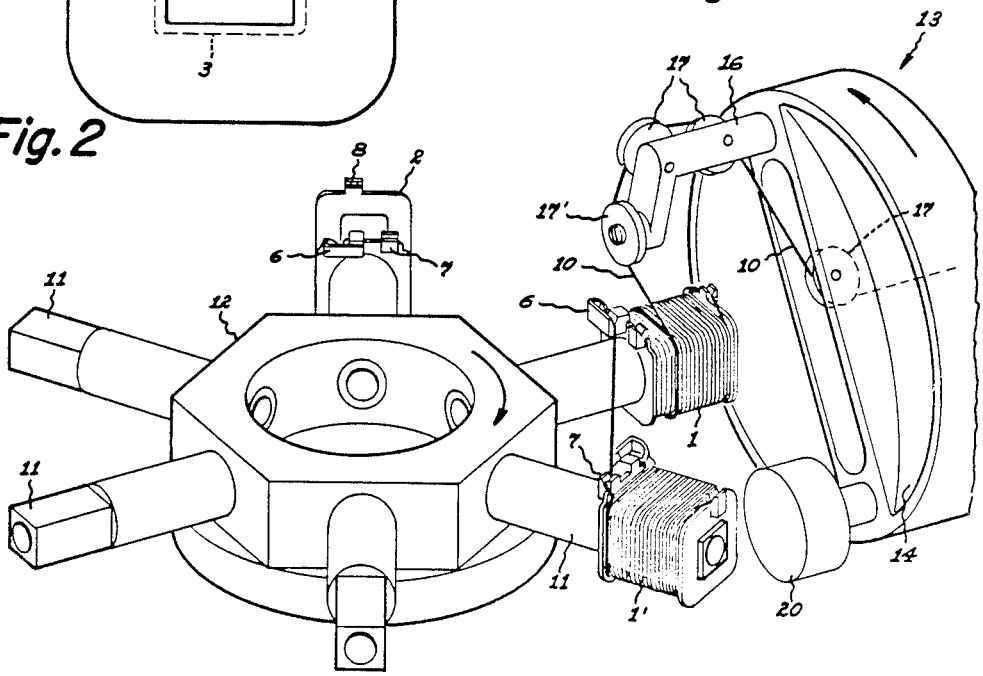
Fig. 4

PRECISION COIL WINDING MACHINE AND METHOD

This application is a continuation, of application Ser. No. 678,857, filed 12/6/84 now abandoned.

The invention relates to a new and improved machine and method for precision winding of wire on bobbins to make coils for reactors and transformers.

BACKGROUND OF THE INVENTION

Precision winding of coils in which the turns of each successive layer are laid or nested in the valleys between the close-wound turns of the preceding layer is desired because it is most compact and therefore most economical of copper or aluminum wire for the coil and of iron for the core. In coil winding, the wire may be wound on the bobbin by revolving the bobbin as the wire is guided to it, or, alternatively, by wrapping the wire around a stationary bobbin by means of a revolving winding head, commonly referred to as a fly head winder. In either method, for compact precision winding, the wire guide or the fly head is caused to traverse across the width of the bobbin at a constant rate determined by the width of the wire and corresponding to one wire diameter per turn.

A constant rate of traverse comparable to the winding of a helix assures smooth even coiling when winding on a round drum-like surface but not when winding on a rectangular or box-like surface. The laminated iron cores used in transformers and reactors are made by stacking laminae so that they are rectangular in cross section. The bobbins are ordinarily provided with rectangular windows to accommodate the cores, and as a result, the coil support surface or drum is rectangular in cross section. In such a rectangular bobbin, an inclined wedge, sometimes known as a kicker, is built in next to the flange where winding starts. The kicker is put in the fourth panel of the winding surface and, starting with zero width, widens to one wire diameter over the length of the panel. Its function is to force the wire over so that it lies alongside the first turn at the start of the second turn.

In coiling, in order to assure tight close-wound turns, the wire is supplied to the bobbin at a slight angle off normal to the drum surface, so that it "leans" slightly, initially into the flange, and thereafter into the preceding turn. A uniform rate of traverse of the wire guide or fly head winder when winding on a rectangular bobbin entails a cyclic variation in the extent to which the wire leans against the preceding turn. Starting at the flange, on the first, second, and third panels of the bobbin's winding surface, the wire leans progressively less against the flange and as it is put down parallel to the flange. On the fourth panel, the kicker forces the wire laterally over at a slight diagonal away from the flange, so that it is displaced the width of one turn or wire diameter before encountering the first panel again. This restores the "lean" to its maximum. Upon reaching the fourth panel on the next turn, it is the prelaid inclined wire of the previous turn that forces the wire over, and this happens for each succeeding turn in the layer. Thus in precision winding according to the current practice, the wire is continuously supplied at a cyclically varying "lean" or pressure against the prelaid turn and must slide down and off the shoulder of the prelaid turn to lie alongside of it. The new turns will conform to the wire lay only so long as the foregoing takes place.

The "lean" or pressure against the prelaid turn varies cyclically from a maximum at the beginning of the first panel to something not less than zero at the beginning of the fourth panel. There cannot be a negative pressure, but if the wire does not lean against the preceding turn at all, there may be a gap between turns which, if cumulated, will cause a defect. At the other extreme, if the "lean" or pressure is too great, the wire will not slide off and fall alongside the preceding turn but will, instead, climb up on the preceding turn, thus creating another kind of defect. On the next layer of turns, the defect may be repeated and magnified. At each layer of turns, the direction of the "lean" must be reversed. Tolerance errors such as those due to undersize or oversize wire are cumulative at least through a layer so that defects tend to occur at the reversals or just prior to the reversals.

Precision winding by the above-described prior art method of conforming to the prelaid wire lay has required stringent control of wire size and ductility, the use of accurately formed bobbins free of defects, and careful machine adjustment including control of wire tension. The extent to which tension in the wire causes the wire to stretch during winding varies with ductility of the wire and stretching effectively reduces the wire size so that control of wire tension may be critical. Since the errors in tolerance are cumulative throughout a layer, the machine must be closely watched by an operator to make sure that the lay down of wire is good.

SUMMARY OF THE INVENTION

The object of the invention is to provide an improved method of coil winding together with a machine for so doing which is more accurate than the conventional way, less critical in respect of wire sizes and ductility, less demanding in respect of machine adjustment, and which produces fewer defective products which must be rejected, and requires less attention on the part of the machine operator.

In accordance with the invention, I use a fine incremental control of the traverse of either a wire guide or a fly head winder, simultaneously with spin or angular control of either the revolving bobbin or the revolving winder to put all portions of each turn of wire at the ideal positions therefor on the bobbin. The positions are mathematically predetermined on the basis of a planned pattern, such as a perfect fit of a given number of turns of the nominal wire size per layer with allowance for maximum tolerance or departure therefrom on a bobbin complying perfectly with its design dimensions. The traverse of the guide or winder is controlled at all times to put the wire down on the bobbin at the ideal position without dependance on the lay of prelaid turns. By so doing, the cumulation of tolerance errors which occurs with the prior art practice of conforming each successive turn to the previously laid turn is avoided. Tolerance errors such as those of oversize or undersize wire remain distributed throughout the coiling and do not result in defects requiring rejection of the coil, and criticality in machine adjustment is greatly reduced.

In a preferred machine embodiment utilizing my method, bobbins mounted on mandrels projecting from a revolving turret are indexed successively into position at a winding station, and a spinning and traversing fly head winder puts wire down on the bobbin while it is held stationary at the winding station. A head spin servo motor and electronic drive amplifier therefor control the angular velocity of the fly head. A resolver or synchrodevice mechanically coupled to the spin servo motor provides angular position or orientation feedback signals through an input channel to an appropriately programmed computer which supplies a control signal through an output channel to the spin drive amplifier. A traverse servo motor and electronic drive amplifier therefor vary the linear position of the fly head, that is, cause it to traverse back and forth relative to the bobbin. Traverse position feedback signals are supplied by a transducer through another input channel to the computer which supplies control signals through another output channel to the traverse drive amplifier.

The computer has essential data on a wire coiling profile stored in its memory and it is programmed to read the feedback signals and provide appropriate control signals through the output channels to the spin drive amplifier and to the traverse drive amplifier to cause the fly head winder to duplicate the wire coiling profile. By way of example, in winding a coil on a rectangular bobbin provided with a kicker in the 4th panel, there is no traverse while winding around the first three panels; the entire traverse occurs while winding around the 4th panel and is equal to one wire diameter having the dimension recorded in the computer's memory. As a result the position of a particular turn does not change with variations in wire size or lay down of preceding turns so that errors cannot cumulate and the defects caused by cumulation of errors are avoided. An increment turns counter reverses the direction of traverse in successive layers and a total turns counter terminates the winding operation.

DESCRIPTION OF THE DRAWINGS

FIG. 1 is a plan view of a reactor bobbin on which a coil may be wound in practising the invention.

FIG. 2 is an end view of the same bobbin.

FIG. 3 shows in partly schematic form the completely wound reactor coil.

FIG. 4 is a pictorial view of a winding head and turret used in a coil winding machine embodying the invention.

DETAILED DESCRIPTION

Figure 5:
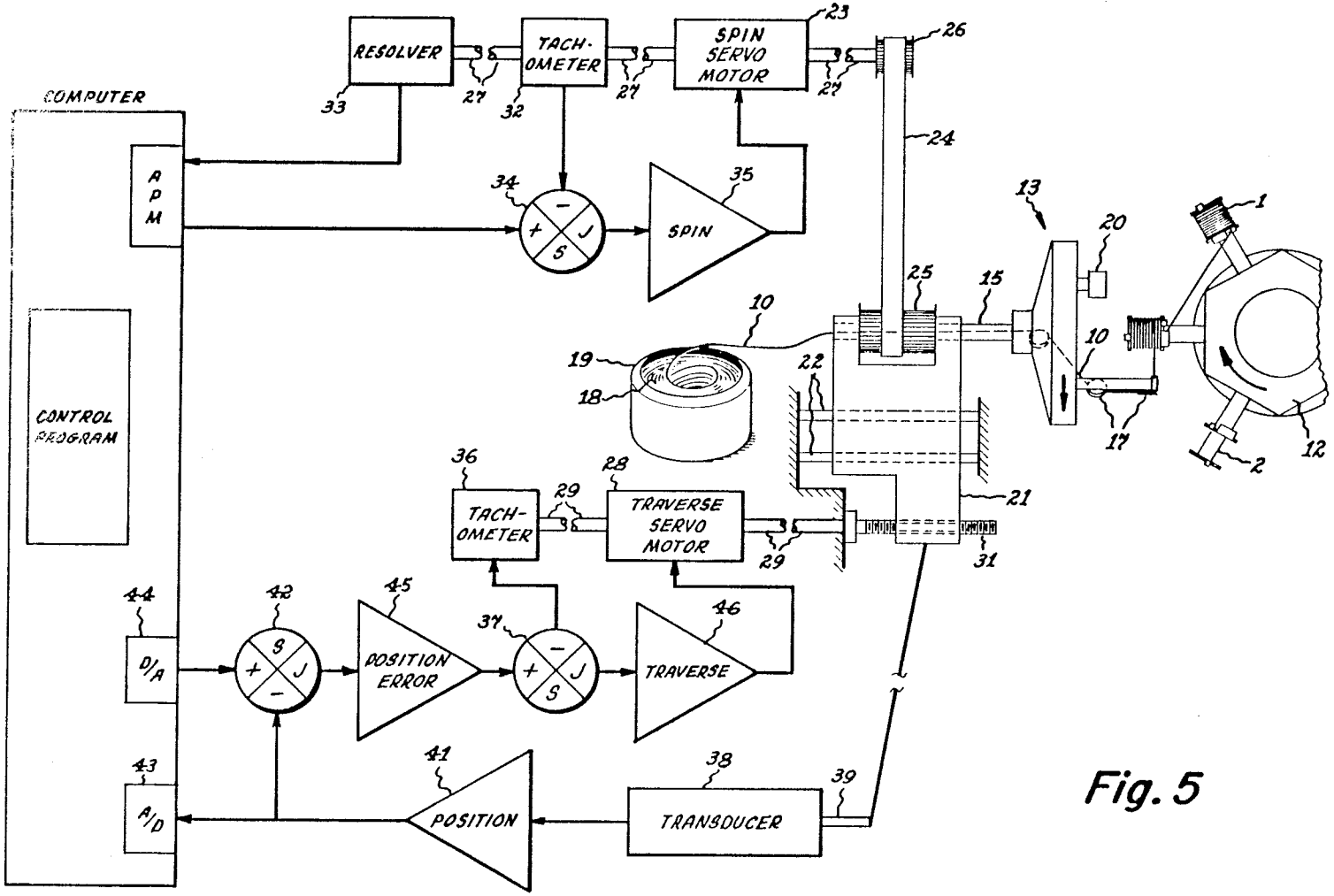
FIG. 5 is a block diagram of the computerized traverse and winding control system embodying the invention.

For convenience the invention will be described and explained with reference to winding on the bobbin shown in FIGS. 1 and 2 the tapped reactor coil assembly shown in FIG. 3. The coil assembly 1 comprises a bobbin 2 having a coil supporting surface 3 of square cross-section surrounding the winding axis, and side flanges 4, 5 normal to the coil supporting surface. The bobbin is made of a suitable insulating plastic, for instance glass fiber-filled polyester. Flange 4 has two box-like portions defining contact retaining cavities 6, 7 on its outboard side, and flange 5 has a similar portion on its outboard side defining cavity 8. The cavities have slotted V-notched side walls with the slots 9 extending down from the open top. The slots allow the wire 10 to be automatically guided through the cavities by suitable excursions of the fly head winder outboard of the flanges. Suitable terminals or solderless contacts having bifurcated and barbed lower ends are pressed down into the cavities to engage the wire and provide connections thereto. Reference may be made to the copending application of Gunnels, Willis and Osteen, Ser. No. 912676 which is a continuation of Ser. No. 652,233, filed Sept. 19, 1984, entitled "Bobbins, Coils and Manufacture of Coil Assemblies, and assigned like the present invention, for a more complete description of the coil assembly and component parts.

To manufacture coil assemblies 1, bobbins 2 are threaded or seated on the square distal ends of the six mandrels 11 projecting from revolving turret 12 shown in FIG. 4. The turret is indexed or revolved intermittently clockwise in 60° increments to present successive bobbins at the winding station in axial alignment with fly head winder 13. The winder comprises a diametrally braced pan-shaped member 14 fast on the front end of a hollow shaft 15. Wire guide pulleys 17, some supported by a crank 16 on one side of member 14, allow the wire 10 to be supplied through the shaft without sharp bends and wrapped around the bobbin. The wire may be supplied to the rear end of shaft 15 by drawing it in conventional fashion from the inside of a coil 18 thereof reposing in a can 19 shown in FIG. 5. The weight of the crank and pulleys is balanced by a counterweight 20 on the opposite side of member 14 to permit high speed winding.

The winding of wire on bobbin 2 at the winding station is begun by causing the fly head to pass wire 10 through start cavity 6 on the bobbin. In the first bobbin to be processed, the wire is anchored, suitably at 10*a* (FIG. 3) in cavity 6, by jamming it into the slots 9 in the cavity walls. Thereafter in subsequent bobbins, the wire extends from exit cavity 7 of the prior bobbin, to start cavity 6 of the bobbin present at the winding station, as shown in FIG. 4. As the fly head begins to revolve, its lineal or traverse position relative to the bobbin is such that the end pulley 17' initially wraps the wire around the bobbin next to flange 4. The controlled spin and traverse of the fly head then proceeds to lay down close wound turns side-by-side at mathematically predetermined positions, as indicated for a few turns at 10*b* in the first layer (FIG. 3). As previously explained, in a rectangular bobbin such as illustrated, the entire traverse equal to one nominal wire width (plus tolerance) per turn occurs during the 90° wrap around the fourth panel of the bobbin's coil supporting surface, and there is no traverse or lineal displacement of the fly head during the 270° wrap around the other three panels.

As the layers of turns are built up, the turns are staggered in successive layers, that is, they are displaced laterally by half the width of the wire in successive layers in order to achieve closer packing. The dotted diagonal lines 10*c* in FIG. 3 are meant to represent the build up of turns up to the next to last layer which ends at flange 5. The fly head then takes the wire in a winding excursion 10*d* beyond flange 5 through tap cavity 8 and then winds the last layer represented by dotted diagonal lines 10*e*. The final layer of turns intervening between the top and the finish make the primary of a pulse starter and may be open-wound, that is wound with gaps between turns to achieve even distribution of fewer turns than are accommodated in the close-wound preceding layers. The winding is terminated by causing the fly head to pass the wire through finish cavity 7 as shown at 10*f*. The turret is then indexed 60° and the wire remains anchored in the finish cavity 7 of the coil assembly that was just completed while being drawn through the start cavity 6 of the next bobbin presented at the winding station.

The mechanical arrangement for controlling the spin and traverse of the fly head winder 13 is shown in diagrammatic form in FIG. 5. Shaft 15 carrying the fly head is journalled in a headstock 21 slideably supported on rods 22 to allow traverse. Spin of the fly head is controlled through head spin servo motor 23 mechanically coupled thereto. For ease of illustration there is shown a toothed flexible belt 24 coupling elongated toothed pulley 25 on shaft 15 to toothed pulley 26 on shaft 27 of the spin servo motor. The elongated toothed pulley may of course be replaced by an ordinary toothed pulley and a splined shaft. Traverse of the fly head is controlled through traverse servo motor 28 whose shaft 29 drives a worm screw 31 engaging the headstock. It will be appreciated that the mechanical arrangements illustrated have been simplified and are intended to show principles without being representative of machine design practice.

The head spin servo system is a velocity control constant speed-seeking system. It comprises spin servo motor 23 whose shaft 27 also carries a tachometer 32 and a resolver 33. The tachometer provides a voltage proportional to angular velocity to summing junction or comparator 34. The resolver generates sine and cosine components of voltage proportional to the angular departure from a reference angle. It supplies these components to the axis position module (APM) of the system computer which converts them to digital form and feeds them into input channel #1 of the computer. The APM provides an output signal on the basis of the program stored in the computer, to summing junction 34 wherein such signal is compared with the tachometer voltage to generate an error signal. The error signal is fed into spin drive amplifier 35 which converts it into a power output adequate to drive spin servo motor 23.

The traverse servo system is a position control system. It comprises traverse servo motor 28 whose shaft 29 carries a tachometer 36 in addition to worm screw 31. The tachometer provides a voltage proportional to angular velocity to summing junction 37. The position transducer is in the form of a linear potentiometer 38 having a slider 39 mechanically coupled to the headstock. It provides to position amplifier 41 a signal corresponding to the linear position of the fly head. The signal is amplified, supplied to summing junction 42, and also supplied through an analog to digital converter 43 to input channel #2 of the computer. The computer is programmed to provide a position output signal through digital to analog converter 44 to summing junction 42. In junction 42, the signal from the position amplifier is compared with that from the computer to generate an error signal which is amplified by position error amplifier 45 and supplied to summing junction 37. In junction 37, the error signal is transmitted, to the extent that it exceeds the tachometer voltage, to traverse drive amplifier 46 which converts it into a power output adequate to drive traverse servo motor 28. The traverse amplifier 46 in tandem with position error amplifier 45 assures very rapid traverse or lineal response of the fly head, and the main function of tachometer 36 in supplying to summing junction 37 a signal proportional to speed, is to assure stability by preventing overshoot.

Although the coil winding method of my invention may be carried out in a number of different ways, the preferred and most practical way of doing so is to use a programmed general purpose computer or programmable controller providing electrical outputs which are translatable into machine controlling signals. A suitable equipment is the Series Six Programmable Controller of General Electric Company. Model 60, the smallest one of the series, is adequate for the present purpose. It is described in publication GET-6 748 (Jan. '84) of Programmable Control Department, General Electric Company, Charlottesville, VA 22906. FIGS. 6*a* to 6*e* show a flowchart indicative of suitable programming for producing the tapped reactor coil 1 shown in FIGS. 1 to 3.

Figure 6A:
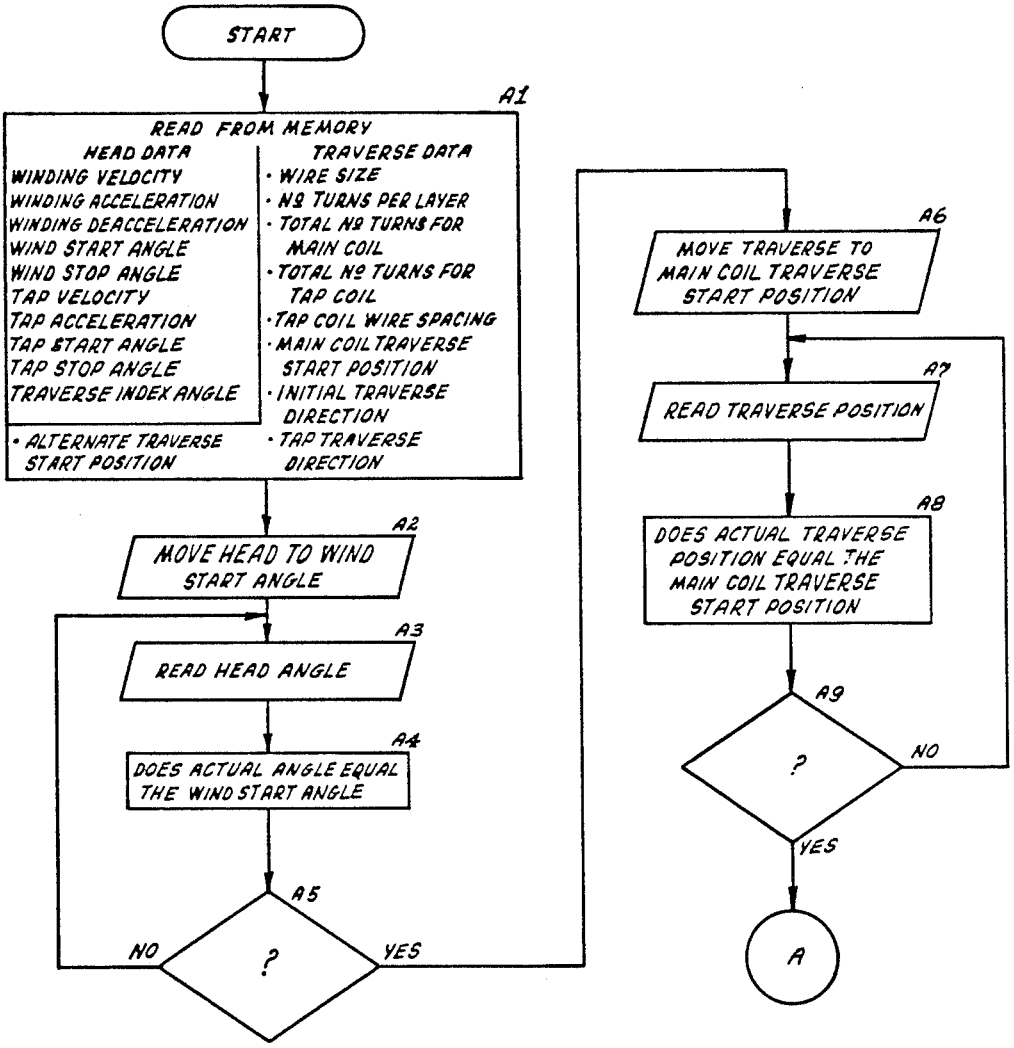
FIGS. 6*a* to 6*e* are a flow chart of the program utilized in the computer.

Referring to FIG. 6*a*, data previously entered into the programmer's memory relative to head winder spin are winding velocity, winding acceleration and winding deceleration. These choices are governed to some extent by the machine capabilities and the sizes of wire and bobbin, and are matters of judgment for the programming engineer. The wind start angle and stop angle will depend on the bobbin construction and the machine set-up. It is desirable to reduce the winding speed during the excursion of the fly head beyond the flange for the tap, so other data entered are tap velocity, tap acceleration, tap start angle, tap stop angle and traverse index angle. Required data relative to head traverse are wire size, number of turns per layer, and total number of turns in the main coil from the start to the tap. The coil designer will have selected the number of turns per layer and then the wire size subject to current and thermal considerations. If necessary, he will modify the bobbin dimensions, that is the distance between flanges, to achieve an integral number of turns per layer in an integral number of turn spaces plus half a space. The half space is necessary to permit staggering of alternate layers in order to have compact nesting of wire turns. Since it is desired to have the main coil as compact as possible, the turns are close-wound and the dimension utilized for wire size or diameter is the nominal size plus an allowance for the maximum oversize wire that must be accommodated. In regards to the tap coil or final layer 10*e* (FIG. 3), the data entered are total number of turns for the tap coil and tap coil wire spacing. Also entered are main coil start position, main coil initial traverse direction and tap coil traverse direction. In order to have staggered successive layers, an alternate main coil start position from which alternate layers are referenced is either entered in memory or calculated from data already entered.

Figure 6B:
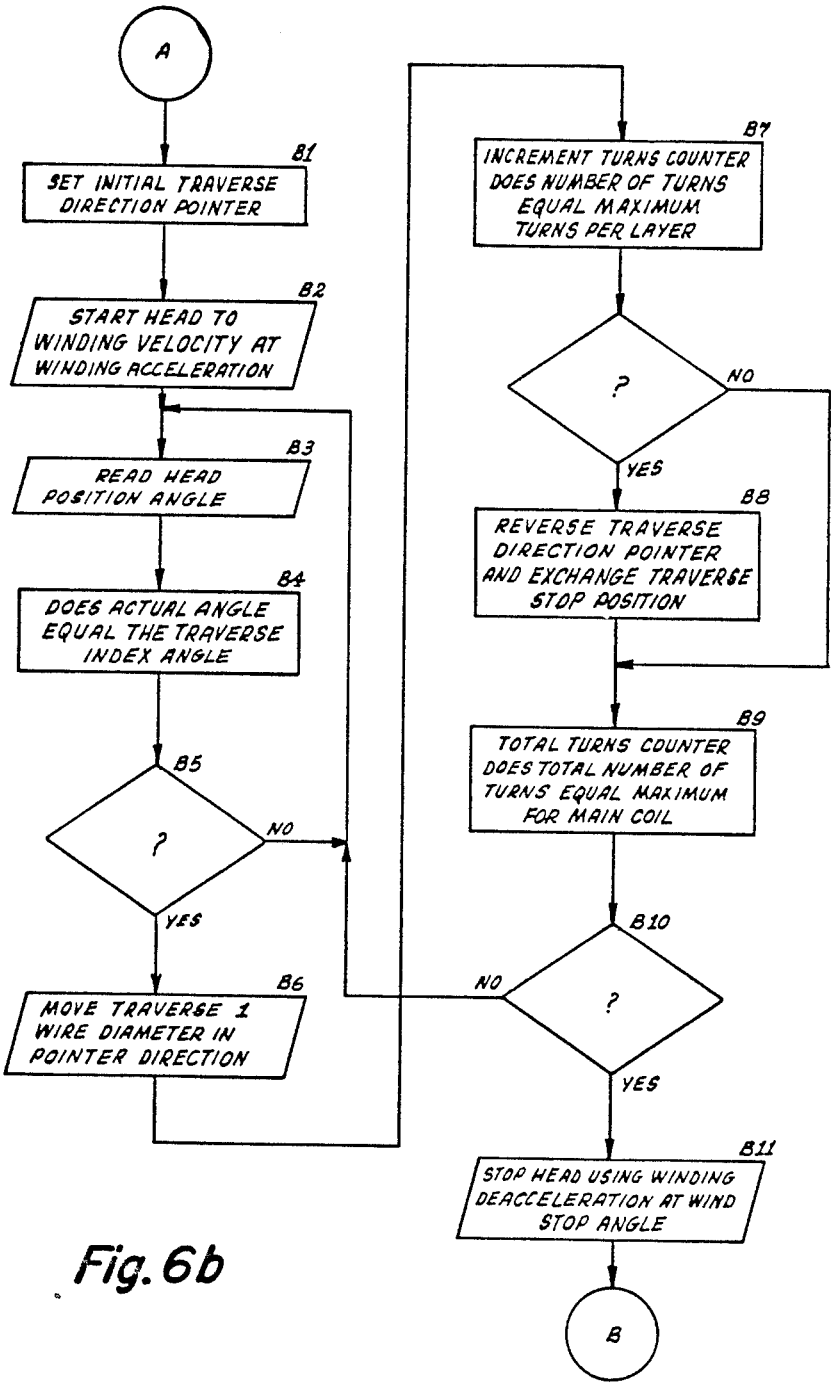
Figure 6C:
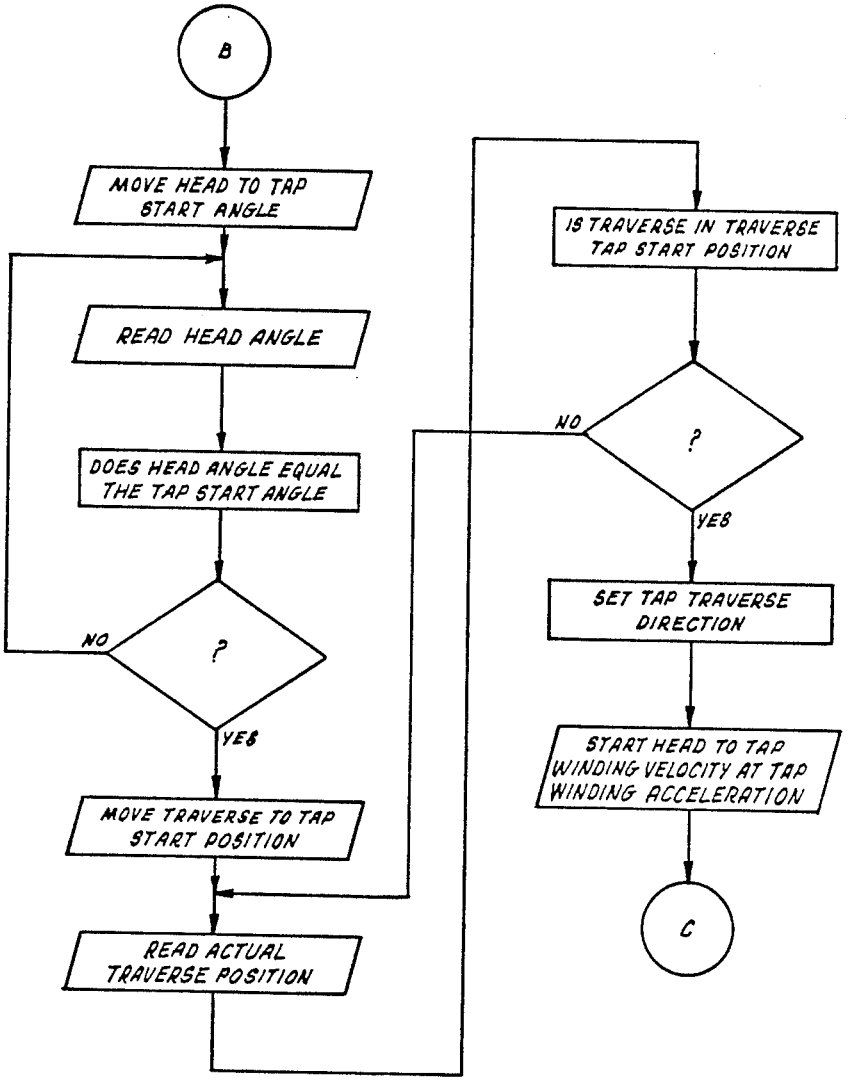
Figure 6D:
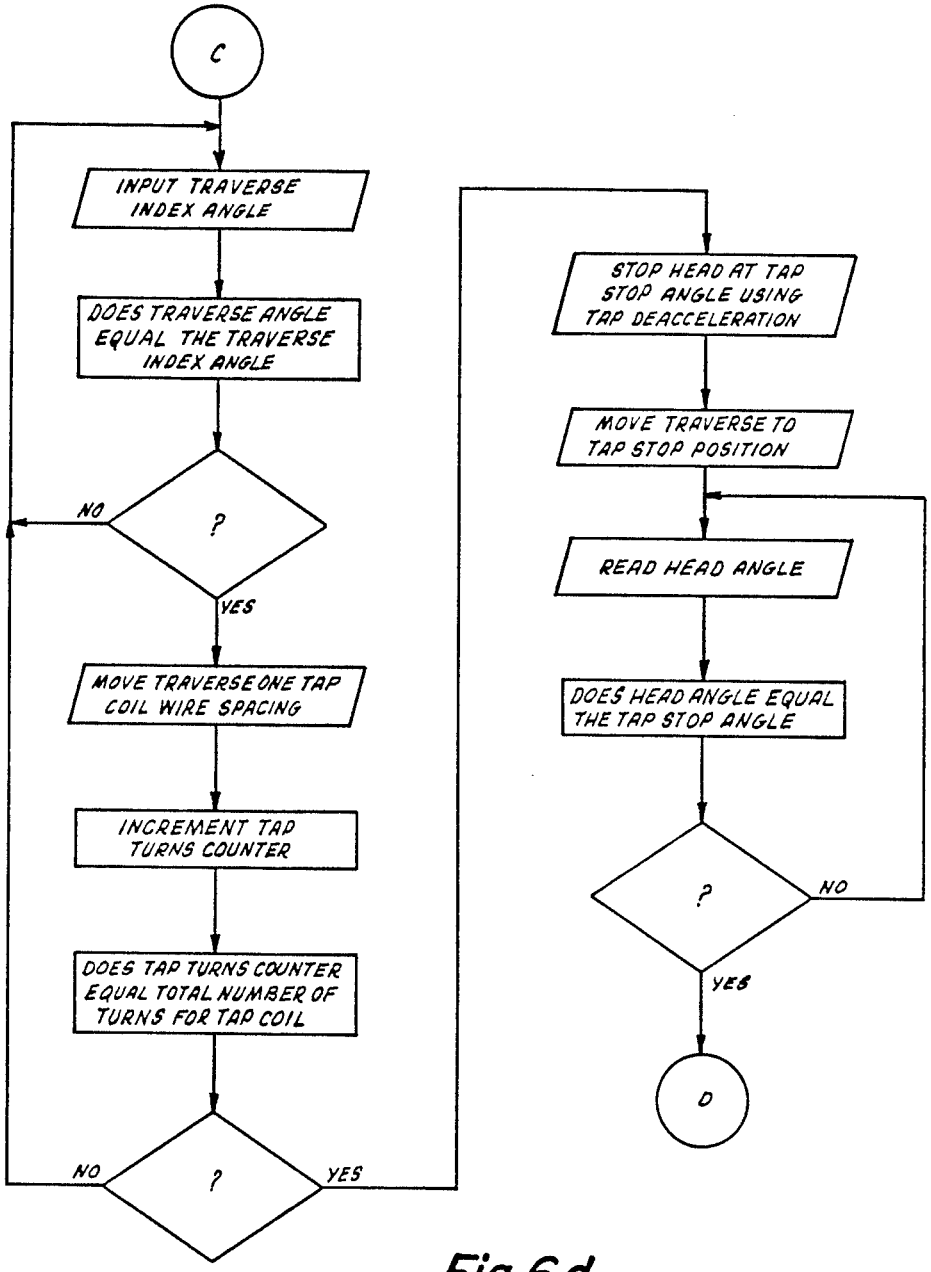
Figure 6E:
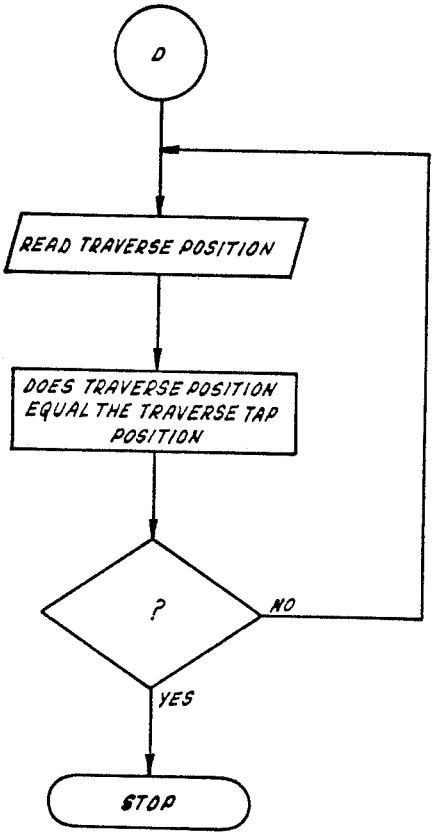

In running the program, (refer to FIG. 6*a*) the computer reads the memory (A1) and outputs "Move (rotate) head (winder) to wind start angle" (A2). The actual head angle is fed back (A3) by the resolver 33 to the APM (axis position module), digitized, read by the computer (A4), and conformed to the memory data by looping (A5). The computer reads the memory A1 and outputs "Move (traverse) head to main coil traverse start position" (A6). The actual head position is fed back (A7) by the linear potentiometer 38 through amplifier 41 (FIG. 5), digitized, read by the computer and conformed to the memory data by looping (A9). The initial traverse direction pointer is set (B1) as indicated in FIG. 6*b*, and the computer outputs "Start (rotate) head to winding velocity at winding acceleration" (B2). The head position angle is fed back (B3), read by the computer (B4), and conformed to the memory data by looping (B5), whereupon the computer outputs "Move traverse 1 wire diameter in pointer direction" (B6). An increment turns counter (B7) is read and when the number of turns in the layer attains the number entered in the memory, the traverse direction pointer is reversed and the traverse start position is exchanged or alternated. (B8). Such sequence is repeated for each successive layer. A total turns counter (B9) is read, the number of layers and total turns is built up by looping (B10) until the number entered in the memory is attained, whereupon the computer outputs "Stop head using winding deceleration at wind stop angle" (B11).

The computer then outputs "Move (rotate) head to tap start angle" (C1), (refer to FIG. 6*c*), the fly head angle is inputted (C2), read by the computer (C3), and conformed to the tap start angle by looping (C4). The computer also outputs "Move (traverse) to tap start position" (C5), the fly head position is inputted (C6), read by the computer (C7), and conformed to the tap start position by looping (C8). The computer then sets the tap traverse direction (C9) and outputs "Start head to tap winding velocity at tap winding acceleration" (C10). The traverse index angle is inputted (D1), (refer to FIG. 6*d*), read by the computer (D2), and conformed to the traverse index angle by looping (D3), whereupon the computer outputs "Move traverse one tap coil wire spacing" (D4).

The turn spacing in the tap coil layer, as previously stated, produces an open winding that will uniformly distribute the tap turns between their start at 10*d* and their finish at 10*f* as indicated diagrammatically in FIG. 3. The tap turn counter is incremented at every turn (D5) and read by the computer (D6), and when the turns attain the number entered in the memory, the looping (D7) which has been continuing the winding is terminated. The computer then outputs "Stop head at tap stop angle using tap deceleration" (D8), and "Move traverse to tap stop position" (D9). The head angle is inputted (D10), read by the computer (D11), and conformed by looping (D12) to the value entered in the computer's memory. The head traverse position is inputted (E1) (refer to FIG. 6*e*), read by the computer (E2), and conformed by looping (E3) which terminates the sequence.

The winding operation is ended with the wire passing through the finish cavity 7. In the illustration in FIG. 4, the wire has not yet been passed through finish cavity 7 of coil 1 at the winding station, but it is seen extending from finish cavity 7 of coil 1′ ahead of coil 1 back to start cavity 6 of coil 1. A matrix of successive positions which will cause the fly head winder to move in such manner as to lay the wire in the appropriate start, tap and finish cavities in the manner earlier described will ordinarily be programmed into the computer in addition to the programming which has been detailed. In actual practice, bare bobbins are loaded, either manually or automatically, onto the mandrels 11 at a loading station prior to the winding station. The coils are wound in a continuous sequence and remain interconnected up to a later station where bifurcated and barbed terminals are pressed into the cavities to engage and anchor the wire. At that time the interconnecting wire is cut and the coil is then unloaded from its mandrel. These operations are performed during the intervals when the revolving turret 12 is stopped and winding is occurring at the winding station. If desired other operations such as bobbin loading, turret advance, terminal insertion, wire cutting, coil unloading etc. may be automated and controlled through the computer along with coil winding.

The tapped reactor coil which has been described is but one example of a winding task that may be performed using my process in which every portion of each turn of wire is put down on the bobbin at the ideal mathematically predetermined position therefor. In the aforementioned copending application of Gunnels et al, there is described a lag transformer ballast utilizing a double bobbin having twin coil support portions with bridging sections on which terminal housings are provided. Such double coil may readily be wound by the computer controlled fly head winder described herein. Of course different coils having different winding patterns will require different programs and data on different wire coiling profiles in the computer memory to run the computer and control the winder. The substitution of programs or of data in a computer is quickly and conveniently effected, and my invention thus provides a coil winding system having great versatility in addition to its other advantages.

While the invention, both as regards the method and as regards preferred apparatus utilizing the method, has been described in detail with reference to its application to make a particular reactor coil, it will be understood that the particular steps and specific equipment and program are intended to be representative of a wide variety which may utilize the principles of the invention. It is therefore desired that the invention be limited only by the appended claims which are intended to cover all modifications falling within the spirit and scope of the invention which those skilled in the art may make.

What I claim as new and desire to secure by Letters Patent of the United States is:

1. Apparatus for precision winding of successive turns of a coiled wire on bobbins to make coils comprising:

means for holding a bobbin at a winding station, a spinning and traversing fly head winder for wrapping wire around the bobin at said station, spin servo motor means coupled to said winder, an electronic spin amplifier therefor, and feedback means providing electrical signals indicative of the angular position of said winder, traverse servo motor means varying the linear position of said winder, a traverse electronic amplifier therefor, and feedback means providing electrical signals indicative of the linear position of said winder, computer means including a memory for storing data for defining a coil winding profile having a predetermined ideal position for said successive turns of wire, a pair of input channels for receiving the electrical signals from said feedback means, and a pair of output channels to said electronic amplifiers for transmitting control signals thereto, said computer means being programmed to read said electrical signals and provide control signals to said output channels causing said fly head winder to place each turn of said wire at said predetermined ideal position for said turn without dependence on the lay of the previous turn.

2. Apparatus as in claim 1 including a tachometer and a resolver mechanically coupled to the spin servo motor means, wherein the tachometer is electrically coupled to the spin electronic amplifier through a summing junction, the resolver is electrically coupled to one computer input channel, and one computer output channel is connected to the spin electronic amplifier through said summing junction.

3. Apparatus as in claim 1 including a tachometer mechanically coupled to the traverse servo motor means and electrically coupled to the traverse electronic amplifier through a summing junction, a transducer arranged to follow the linear position of the winder and electrically coupled to the other input channel, and wherein the other output channel is connected to the traverse electronic amplifier through said summing junction.

4. Apparatus as in claim 3 wherein the tachometer is electrically coupled to the traverse electronic amplifier through a first summing junction, said transducer is a linear potentiometer which is electrically coupled through a position amplifier to the other input channel and to a second summing junction, and which includes a position error amplifier connected to amplify a control signal received at the second summing junction and supply it through the first summing junction to said traverse electronic amplifier.

5. Apparatus as in claim 1 including rotary turret means supporting a plurality of mandrels.

* * * * *